United States Patent [19]

Weits et al.

[11] Patent Number: 4,838,419

[45] Date of Patent: Jun. 13, 1989

[54] KEG BOARD

[75] Inventors: Ferdinand Weits, Westminster; William F. Mekelburg, Arvada, both of Colo.; Marc R. Latour, Lafayette, Calif.

[73] Assignee: Adolph Coors Company, Golden, Colo.

[21] Appl. No.: 27,266

[22] Filed: Mar. 18, 1987

[51] Int. Cl.[4] ..... B65D 71/00

[52] U.S. Cl. ..... 206/386; 206/503; 206/821; 217/26.5

[58] Field of Search ..... 108/55.1, 53.1, 53.3, 108/53.5; 206/386, 427, 433, 499, 508, 521, 522, 558, 564, 565, 585, 593, 595–600, 821, 503; 217/21, 26, 26.5, 27, 28

[56] References Cited

U.S. PATENT DOCUMENTS

| | | | |
|---|---|---|---|
| 1,853,374 | 4/1932 | Oxhandler | 217/26 |
| 3,351,264 | 11/1967 | Bostrom | 206/499 |
| 3,366,231 | 1/1968 | Trakas | 206/597 |
| 3,563,184 | 2/1971 | Angelbeck, Jr. | 108/53.5 |
| 3,948,190 | 4/1976 | Cook, III et al. | 108/55.3 |
| 3,993,168 | 11/1976 | Kubick | 108/55.3 |
| 4,263,855 | 4/1981 | Lawlor | 108/53.3 |

FOREIGN PATENT DOCUMENTS

| | | | |
|---|---|---|---|
| 1141941 | 12/1962 | Fed. Rep. of Germany | 206/522 |
| 1268059 | 5/1968 | Fed. Rep. of Germany | 108/55.3 |
| 2081669 | 2/1982 | United Kingdom | 206/386 |
| 2175878 | 12/1986 | United Kingdom | 206/386 |

*Primary Examiner*—Jimmy G. Foster
*Attorney, Agent, or Firm*—Klaas & Law

[57] ABSTRACT

A keg board for use in stacking beer kegs and the like in an upright orientation during storage and transporation of the kegs comprising: a generally planar surface for engaging and supporting a generally planar end surface of each keg; and pockets operatively associated with the planar surface for limiting relative lateral shifting movement of the kegs such as caused by shocks and vibration associated with transporting of the kegs.

14 Claims, 5 Drawing Sheets

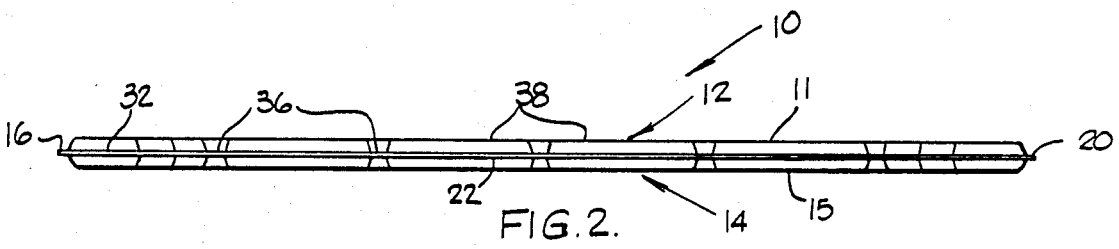
FIG. 2.
FIG. 1.
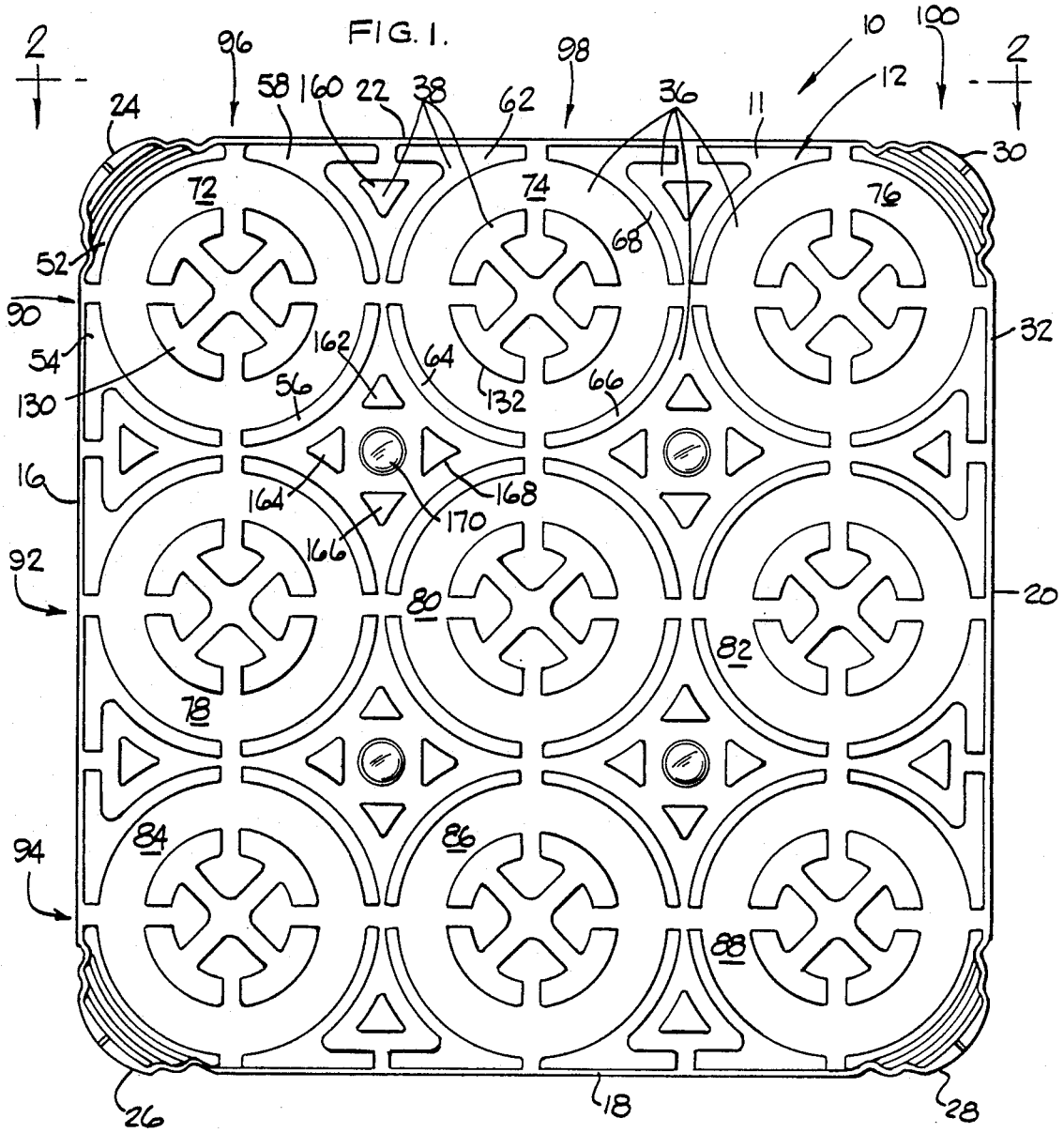

FIG. 3.
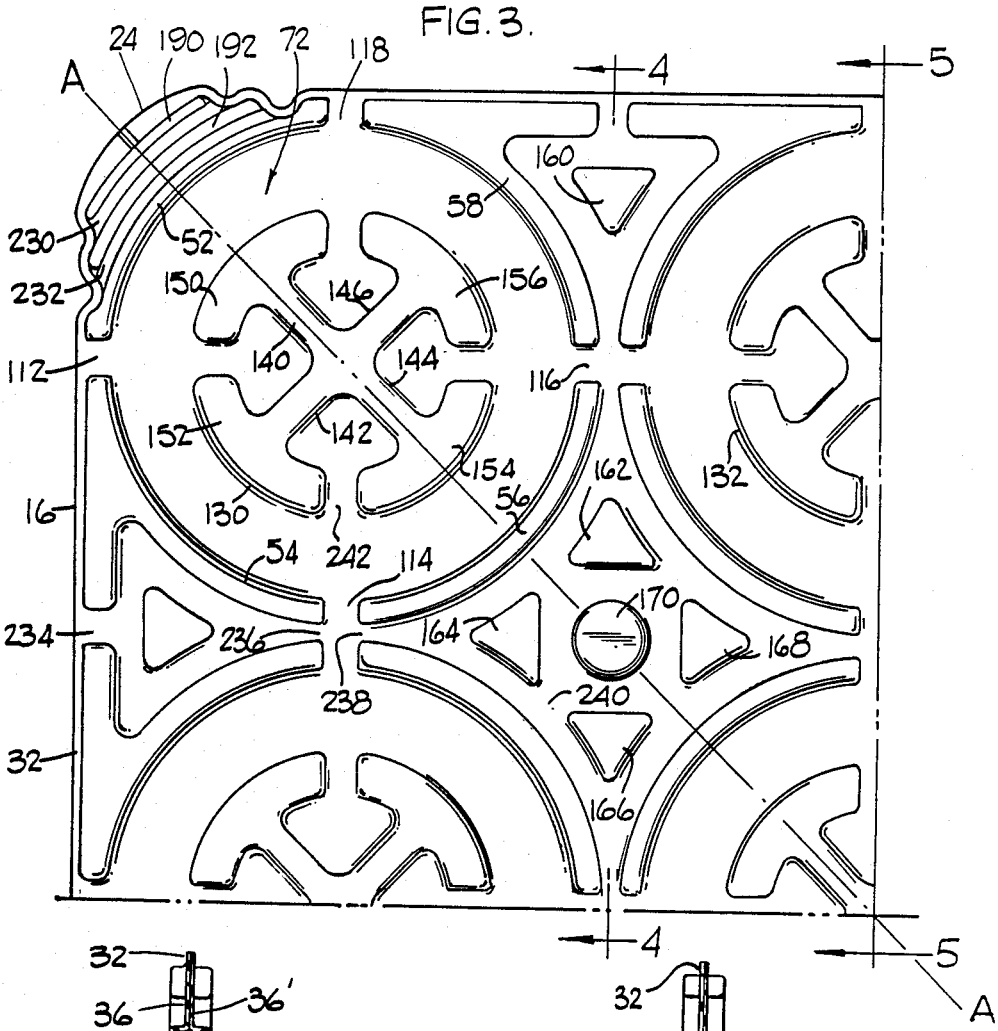
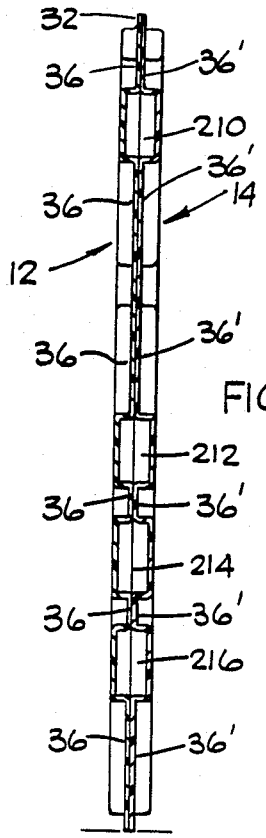
FIG. 4
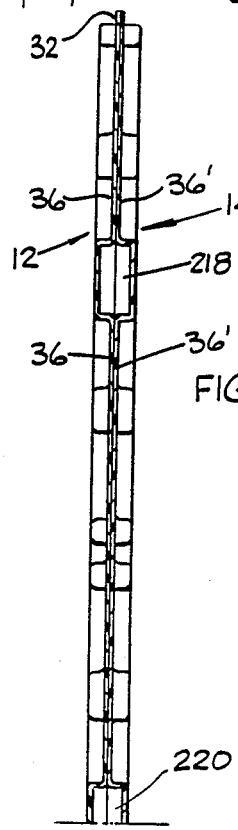
FIG. 5.

FIG. 10
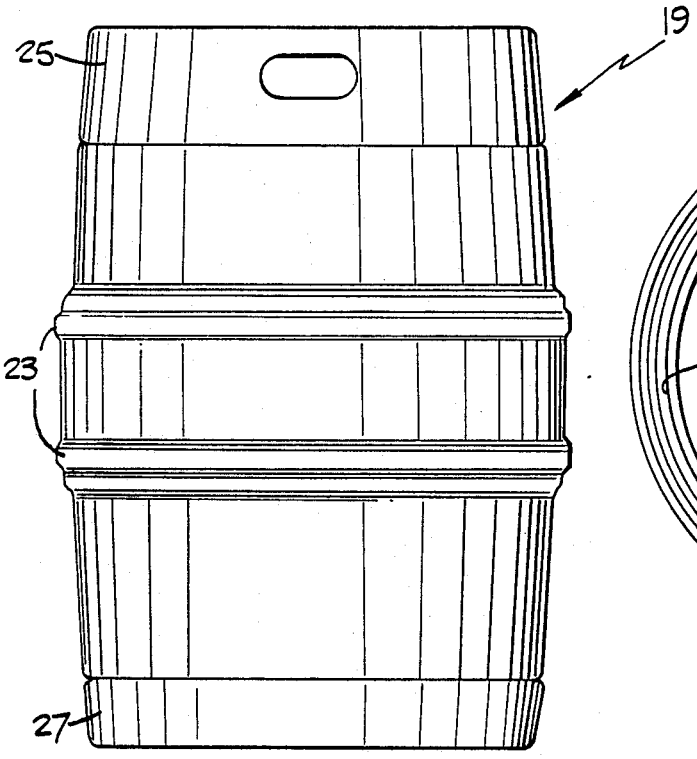
FIG. 11.
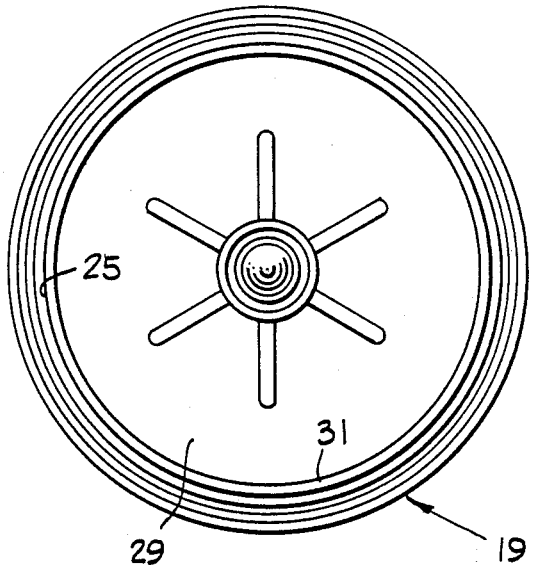
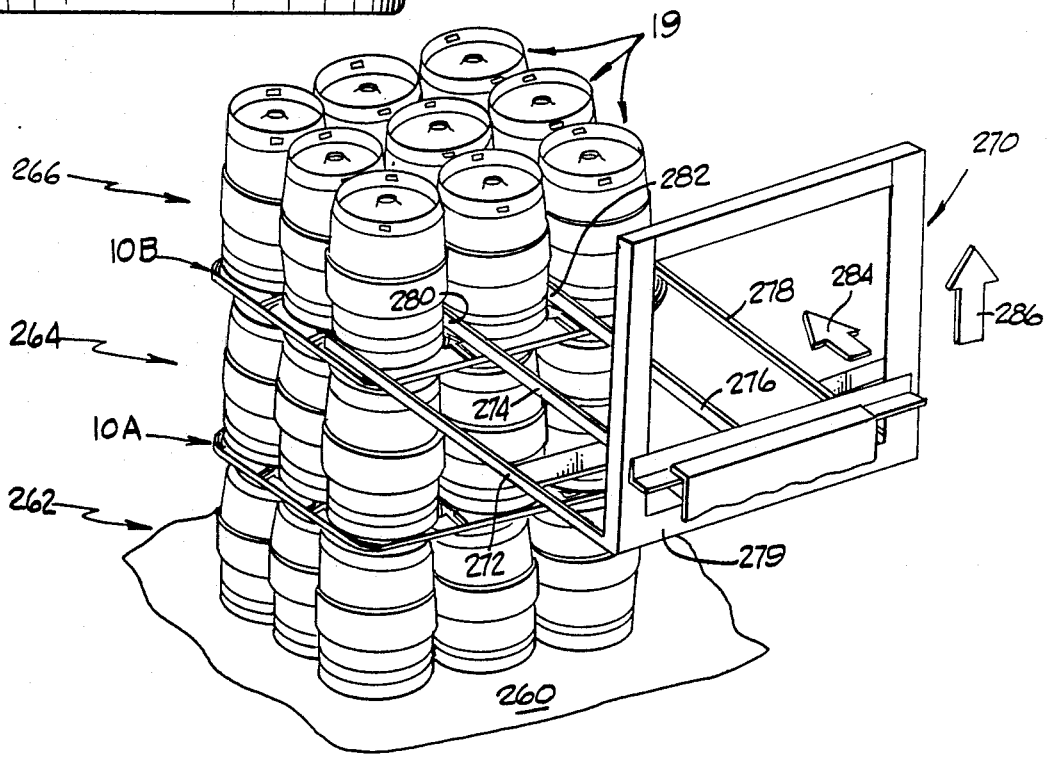
FIG. 12.

KEG BOARD

BACKGROUND OF THE INVENTION

The present invention relates generally to cargo pallets and, more specifically, to a beer keg pallet or keg board used for stacking beer kegs of the type which are shipped in an upright orientation.

In large volume beer keg shipping operations, such as between a brewery and distributor, etc., beer keg cargos have traditionally been shipped in two different stacking arrangements. In one stacking arrangement, the beer kegs are positioned with the longitudinal axis of the keg in a horizontal configuration. In this arrangement, the kegs are mounted in racks having curved receiving portions which engages circumferential sidewall portions of a beer keg. In the other stacking arrangement, beer kegs are oriented with the central longitudinal axis of each beer keg in a generally vertical or "upright" orientation. In this mounting arrangement, beer kegs have traditionally been placed in side-by-side relationship on 4 foot by 4 foot plywood sheets. The dimensions of the beer kegs (typically a middle diameter of 17 inches and end diameters of 14.5 inches) are such that the kegs may be positioned in a 3×3 rectangular gridwork on each plywood sheet. The beer kegs are generally stacked in four tiers, i.e. four kegs high, with keg boards positioned between tiers, when the kegs are shipped by railcar. When shipped by truck, kegs are generally stacked in two tiers with keg boards positioned between the two tiers. In shipping by truck, a six keg (2×3) board having two rows of three kegs each is generally used in combination with a nine keg (3×3) board in order to occupy the entire width of the truck, i.e. a conventional truck cargo area is five kegs wide.

When shipping kegs in a vertical orientation, a continuing problem has been that the kegs tend to shift laterally due to shocks and vibrations encountered in transit. During such lateral shifting, the kegs often move with sufficient force to cause damage to the kegs, plywood keg boards and surrounding bulk head material positioned between stacks of kegs. The lateral shifting of the kegs also changes the alignment of the kegs from the uniform rows and columns in which the kegs are originally positioned to a more random positioning. A problem with such a random positioning is that, during large scale unloading operations in which forklifts are employed, the kegs must be manually realigned to provide ample space for inserting the prongs of the forklift between the kegs. Keg handling forklifts generally have at least one set of four prongs which enable the fork to engage and lift nine kegs at once in a 3×3 loading arrangement. In most loading operations, two tiers of stacked kegs, i.e. 18 kegs, are moved at once. Often a forklift operator faced with the manual task of aligning the kegs to be loaded simply rams the prong portions of the fork into the kegs to forcibly jam the barrels into a proper alignment for pickup by the forklift. However, such jamming operations tend to damage the kegs and are thus not an approved loading procedure.

One method of overcoming lateral keg shifting and associated problems is to provide a peripheral band around the kegs so as to hold the kegs in a tightly packed configuration which prevents lateral shifting. A problem with this solution is that such banding operations are inconvenient and time consuming and thus generally increase shipping costs.

Another problem associated with conventional methods of shipping beer kegs in an upright orientation is that the plywood keg boards used in such operations are relatively heavy and hard to handle and ar subject to being damaged during collection and return operations. Such boards are especially subject to damage when a board is dropped onto a corner portion thereof from a height of approximately one foot or more.

Objectives of the Invention

It is an objective of the present invention to provide a keg board which prevents lateral shifting of beer kegs stacked thereon.

It is another objective of the present invention to provide a keg board having a top surface and a bottom surface each adapted to receiving beer kegs in laterally stable engagement therewith.

It is another objective of the present invention to provide a keg board which is extremely lightweight in comparison with conventional plywood keg boards.

It is another objective of the present invention to provide a keg board which is sufficiently resilient to absorb shocks, and yet sufficiently stiff to provide a stable platform and to facilitate handling. It is another objective of the present invention to provide a keg board which is constructed from a weather-resistant material.

It is another objective of the present invention to provide a keg board which is not subject to deterioration when subjected to ultraviolet radiation.

It is another objective of the present invention to provide a keg board having a configuration which prevents the collection of moisture thereon.

It is another objective of the present invention to provide a keg board which is cost-effective to produce an use.

SUMMARY OF THE INVENTION

The present invention is directed to a keg board adapted to meet the above described objectives.

Thus, the invention may comprise a keg board for use in stacking beer kegs and the like in an upright orientation during storage and transportation of the kegs comprising: (a) a generally planar surface for engaging and supporting a generally planar end surface of each keg; (b) pocket means operatively associated with said planar surface for limiting relative lateral shifting movement of said kegs such as caused by shocks and vibration associated with transporting of said kegs.

The invention may also comprise a keg board for use with beer kegs and the like of the type having a circular recess in opposite end portions thereof defining ring-shaped, generally planar keg support surfaces, for use in stacking the kegs in an upright orientation during transportation and storage comprising: a first formed sheet of high density, high molecular weight, weather resistant, ultraviolet radiation resistant, relatively thin, flexible, plastic material; said sheet having a generally rectangular shape defined by four generally linear peripheral edge portions and four corner portions and having a front side surface and back side surface; said formed sheet comprising a flat portion and a plurality of projecting portions, said projecting portions defining a plurality of outwardly extending raised portions on said front side surface and a plurality of corresponding recessed portions on said back side surface; said projecting portions comprising a plurality of pocket forming projections arranged in plurality of generally ring-shaped configurations, said ring-shaped pocket configurations each comprising an interior diameter slightly larger than the exterior diameter of an end portion of one of said kegs, said ring-shaped pocket configurations being arranged in a rectangular gridwork of closely spaced rows and columns which are separated by a sufficiently small distance to prevent kegs received in said pocket configurations from being separated by a distance of more than one inch; each of said ring-shaped pocket configurations being provided by four arcuate projecting portions each having a projection height of approximately 0.4 inches and a projection width of at least approximately 0.4 inches and having upper rounded shoulders having a radius of approximately 0.2 inches which are adapted to facilitate seating of a keg in an associated pocket, said four arcuate projecting portions defining each ring-shaped pocket configurations being separated by relatively small circumferential gaps of sufficient dimension to enable drainage of moisture from an area of said flat portion of said sheet which is circumscribed by said four arcuate projecting portions; said plurality of projecting portions of said sheet further comprising a plurality of pocket interior stiffening portions positioned within each of said ring-shaped pocket configurations an adapted to stiffen said sheet of material, said pocket interior portions being positioned in centered relationship within said ring-shaped pocket configurations and having a projection diameter adapted to be positioned within said recess portion of a keg received within an associated pocket and having a projection height approximately equal to said projection height of said pocket forming projections; said plurality of projecting portions further comprising a plurality of pocket exterior stiffening portions having a projection height approximately equal to the height of said pocket forming projections and positioned within areas of said sheet between said ring-shaped pocket configurations and adapted to further stiffen said sheet; said plurality projecting portions further comprising corner shock absorber forming projecting portions comprising three concentric arcuate portions arranged symmetrically about an axis bisecting an associated corner portion and having an arc which is concave toward the center of said sheet, each of said concentric arcuate portions comprising a projection height approximately equal to the height of said pocket forming projection and having a rounded top portion having a radius of approximately 0.2 inches, said concentric arcuate portions being positioned approximately 0.3 inches apart; said projecting portions of said sheet being constructed and arranged to provide gaps within all flat areas enclosed by said projections for enabling drainage of moisture from all areas of said sheet; said corner portions of said sheet comprising a plurality of inwardly projecting curved edge portions adapted to facilitate stacking of the sheets; a second sheet substantially identical to said first sheet, said first sheet and said second sheet being adhered together at said back side surfaces thereof whereby a unitary keg board having identical top and bottom surface defined by said front side surfaces of said two sheet is provided; a linear vent passage provided at each corner of the keg board and defined by a recess portion in the back side surface of each sheet, said vent passage being in fluid communication with the recesses associated with each of the shock absorber forming projections located at an associated corner, said vent passage being in fluid communication with the atmosphere whereby air discharge and intake from said shock absorber forming projections during compression and expansion of said projections is provided.

The invention may also comprise a method of stacking beer kegs for shipping comprising the steps of: (a) providing a keg board of the type comprising: a generally planar surface for engaging and supporting a generally planar end surface of each keg; pocket means operatively associated with said planar surface for limiting relative lateral shifting movement of said kegs such a caused by shocks and vibration associated with transporting of said kegs; said keg board being constructed from two identical plastic sheets, each sheet having planar surfaces on opposite sides thereof, each sheet having a plurality of projecting portions thereon projecting outwardly from one of said planar surfaces and inwardly from the other, said planar surfaces of said two sheets from which said projecting portions project inwardly being adhered together in abutting mirror image relationship whereby the keg board is provided with identical outwardly projecting configurations on opposite exposed surfaces thereof, said outwardly projecting configurations defining said pocket means; (b) placing nine beer kegs in close, upright, adjacent relationship in a square configuration of three rows and three columns; (c) placing the keg board on top of the nine beer kegs with pocket portions on the bottom surface of the keg board engaging the top ends of all of the kegs; (d) stacking nine upper tier kegs on top of the keg board with bottom ends of the upper tier of kegs in engaging relationship with the pockets in the top surface of the keg board.

BRIEF DESCRIPTION OF THE DRAWING

An illustrative and presently preferred embodiment of the invention is shown in the accompanying drawing in which:

FIG. 1 is a top plan view of a nine pocket per side keg board;

FIG. 2 is an elevation view of the keg board of FIG. 1;

FIG. 3 is a detail quarter-section top plan view of the keg board of FIG. 1;

FIG. 4 is a cross sectional view of the keg board quarter section of FIG. 3;

FIG. 5 is another cross sectional view of the keg board quarter section of FIG. 3;

FIG. 8 is a detail elevation view of a portion of the keg board of FIG. 6;

FIG. 10 is a side elevation view of a beer keg.

FIG. 11 is an end view of the beer keg of FIG. 10.

FIG. 12 is an illustration of a keg board in use.

DETAILED DESCRIPTION OF THE INVENTION

Figure 7:
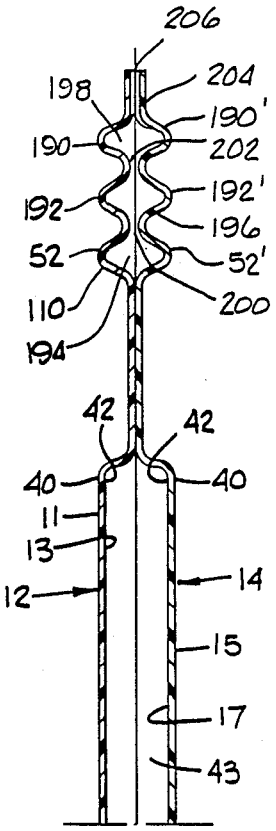
FIG. 7 is a cross sectional view of the keg board of FIG. 6.
Figure 9:
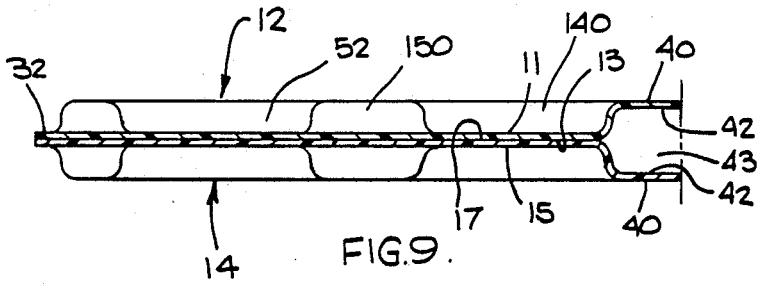
FIG. 9 is another cross sectional view of the keg board of FIG. 6.

The present invention is directed to a keg board 10 for use with beer kegs 19 and the like of the type shown in FIGS. 10–12 having a generally cylindrical configuration with a relatively larger diameter, e.g. 17 inches at a central portion 23 thereof, and relatively smaller diameters, e.g. 14.5 inches at end portions 25, 27 thereof, and having a circular recess 29 in each end, each recess being defined by a rim 31 which may be, e.g., 13.0 inches in diameter and a minimum of 0.5 inch deep and 0.75 inch wide. Such kegs may be provided with different axial lengths to provide either half barrel or quarter barrel kegs. The keg board 10 of the present invention as specifically described hereinafter may be used without modification in either the half barrel or quarter size barrel kegs. The keg board 10 is adapted to enable the stacking of beer kegs in an upright position several tiers high in a manner which prevents lateral shifting of the beer kegs during transportation thereof and which facilitates unloading and loading thereof In one preferred embodiment as best shown in FIGS. 7 and 9, the keg board 10 comprises a first vacuum formed sheet 12 having front surface 11 which provides the keg board top surface, and a back surface 13 which provides one keg board interior surface. The keg board further comprises second formed sheet 14 of identical construction to the first formed sheet which has a front surface 15 which provides the keg board bottom surface, and a back surface 17 which provides another keg board interior surface. Each of the formed sheets 12, 14 is preferably constructed from a dark high density, high molecular weight, weather resistant, ultraviolet radiation resistant, relatively thin, flexible, plastic material such as black colored 0.08 inches thick Phillips Marlex HXM 50100 polyethylene which may be compressed in some areas o a thickness of preferably not less than 0.06 inches during the production of the keg board. The two vacuum formed sheets 12, 14 are adhered together such as by pressing the sheets together, under high pressure, when the sheets are in a heated state, as is conventional and known in the art. At the time the sheets are adhered together, the back surfaces 13, 17 of each sheet are positioned in aligned abutting relationship such that flat portions 36 and projection portions 38 on each sheet are positioned in mirror image relationship.

Since the two formed sheets 12, 14 are substantially identical, reference numerals referring to the various portions of sheet will generally only be provided for the first sheet in order to avoid cluttering the drawing. It is to be understood that the second sheet has identical portions to that of the first sheet which are positioned directly opposite the portions described for the first sheet.

As best shown in FIG. 1, the keg board 10 has a generally rectangular shape comprising a first linear edge portion 16, a second linear edge portion 18, a third linear edge portion 20, a fourth linear edge portion 22, a first corner portion 24, a second corner portion 26, a third corner portion 28, and a fourth corner portion 30, which are all provided by a continuous peripheral edge seam portion 32. Each sheet comprises a flat portion indicated generally at 36 in FIGS. 1 and 2 and a plurality of projection portions indicated generally at 38. Each of the projection portions comprises a raised portion 40 o the front surface 11, 15 of each sheet and a recess portion 42 on the back surface 13, 17 of each sheet, the recessed portions 42 on the opposite sheets defining a plurality of keg board interior cavities 43, as best illustrated in FIGS. 7 and 9.

As shown in FIG. 1, the projection portions 38 of the sheet comprise a plurality of pocket forming projections 52, 54, 56, 58, 62, 64, 66, 68, etc., arranged in a plurality of ring-shaped pocket configurations 72, 74, 76, 78, 80, 82, 84, 86, 88, which are in turn arranged on each of the keg board top surface and bottom surface in a closely spaced gridwork consisting of three pocket rows 90, 92, 94 and three pocket columns 96, 98, 100. Each of the pocket forming projections may comprise a quarter circle arcuate shape having a projection height of approximately 0.4 inches, having a minimum width measured radially of at least 0.4 inches in the projections at the four corners, and of approximately 1.3 inches in pocket forming projections in other regions, and having upper rounded shoulder portions e.g. 110, FIG. 7, having a radius of approximately 0.2 inches. The shoulder portions are adapted to facilitate seating of a keg in an associated pocket in loading situations where the keg may initially not be exactly centered within the pocket, i.e. the rounded shoulders of the pocket forming portions provide a ramp effect which facilitates seating of the kegs. Each of the pocket forming portions which define the ring-shaped pocket configurations are separated by relatively small (e.g. one inch) circumferential gaps 112, 114, 116, 118, etc., FIG. 3, which facilitate drainage of moisture from the interior portion of each pocket. The pockets are spaced to position kegs received in the pocket configurations in close (e.g. 1.0 inch or less) or touching contact to prevent swaying and jarring of the kegs during shipping. In one preferred embodiment, the interior diameter of each pocket is 14.9 inches, the exterior diameter of each pocket is 16.5 inches, and the distance between the centers of adjacent pockets is 17.0 inches. A plurality of pocket interior stiffening projections 130, 132, etc. are centered within associated pockets and, in one preferred embodiment, each comprise four spoke portions 140, 142, 144, 146, FIG. 3, arranged in diagonal relationship with respect to the lateral edge portions of the keg board, and further comprise four arcuate portions 150, 152, 154, 156 connected at the ends of the spoke portions. The pocket interior stiffening projection 130, 132, etc. comprise a diameter sufficiently small to be received within the recessed portion of an associated keg, e.g. a diameter of 9.8 inches. The height of the pocket interior stiffening portions is preferably equal to the height of the pocket forming projections, e.g. 0.4 inches.

The projecting portions 38 also comprise a plurality of pocket exterior stiffening portions such as single triangular portion 160 positioned between adjacent pocket portions near the periphery of the keg board and triangular stiffening portions such as 162, 164, 166, 168 which are arranged in a generally diamond shaped configuration around a circular projection 170 and which are positioned between four adjacent pocket configurations such as 72, 74, 78, 80 in inwardly positioned areas of the keg board. Each of the pocket exterior stiffening portions preferably comprises a projection height equal to the projection height of the pocket forming portions and the interior pocket stiffening portions.

A plurality of shock absorber forming projections e.g. 190, 192, 52 (projection 52 also serves as a pocket forming projection) are provided at each of the four corner portions of the keg board. The shock absorber forming projection comprise concentric arcuate projections which are arranged symmetrically about an axis, e.g. AA, which bisects an associated corner portion. The arc of each shock absorber forming projection opens inwardly, i.e. is concave towards the center of the keg board. Each of the shock absorber forming projections has a projection height approximately equal to that of the above described pocket forming projections and stiffening projections. As best illustrated by FIG. 7, the shock absorber forming projections 190, 192, 52 on the first formed sheet 12 and the associated opposite projections 190', 192', 52' on the second formed sheet 14 define a plurality of bellows chambers 194, 196, 198. The bellows chambers are interconnected by bellows vent passages 200, 202 which enable the bellows to vent to the atmosphere through vent passage 204 and vent opening 206. This bellows arrangement facilitates the resilient compression and expansion of the shock absorber forming projections when the corner of a keg board 10 is subjected to a load such as may be caused by dropping the keg board from a height onto a corner portions thereof.

It should be noted that interior chambers, other than the bellows chambers, formed by recessed portions on the interior surfaces of the two formed sheets, e.g. 210, 212, 214, 216, 218, 220, FIGS. 4 and 5, are isolated from one another by the sealing of the two sheets in the various contact areas of the flat portions 36, 36' thereof. Thus the air within chambers 210, 212, 214, etc. is sealingly trapped therein. When a force is applied to the exterior of a projection forming such chambers, the trapped air tends to support the projection, preventing collapse of the chamber. This construction technique greatly facilitates the handling properties of the keg board 10, providing a stiff and sturdy construction which is, at the same time, relatively lightweight because of the absence of plastic material in the various chamber areas 210, 212, 214, etc.

Figure 6:
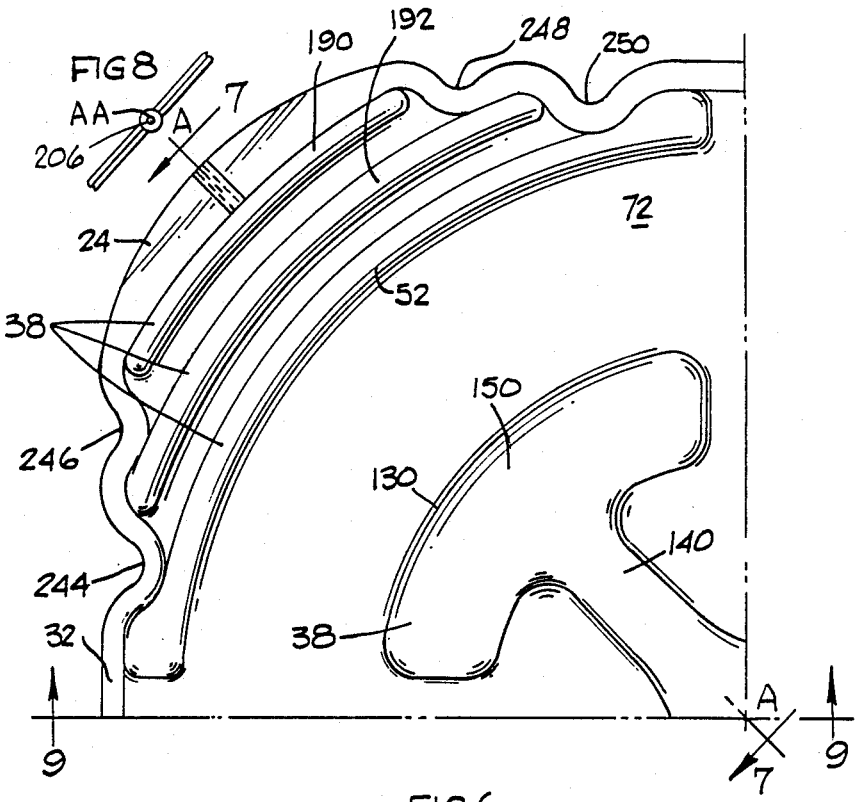
FIG. 6 is a detail top plan view of a corner portion of the quarter section view of FIG. 3.

As illustrated in FIG. 3, a plurality of drainage gaps 230, 232, 234, 236, 238, 240, 242, etc., in addition to the drainage gaps between pocket forming projections, are provided throughout the keg board to prevent the collection of moisture in any of the flat areas thereof, thereby inhibiting the growth of bacteria, fungus, etc. As illustrated in FIG. 6, the edge seam 32 in the corner portions comprises four inwardly projecting curved portions 244, 246, 248, 250 which may be used to facilitate the collection and stacking of the keg boards on a "magazine rack" type storage unit (not shown) having post portions extending perpendicularly of the keg board surfaces 11, 13, 15, 17 which engage the inwardly projecting curved portions 244, 246, 248, 250.

Figure 13:
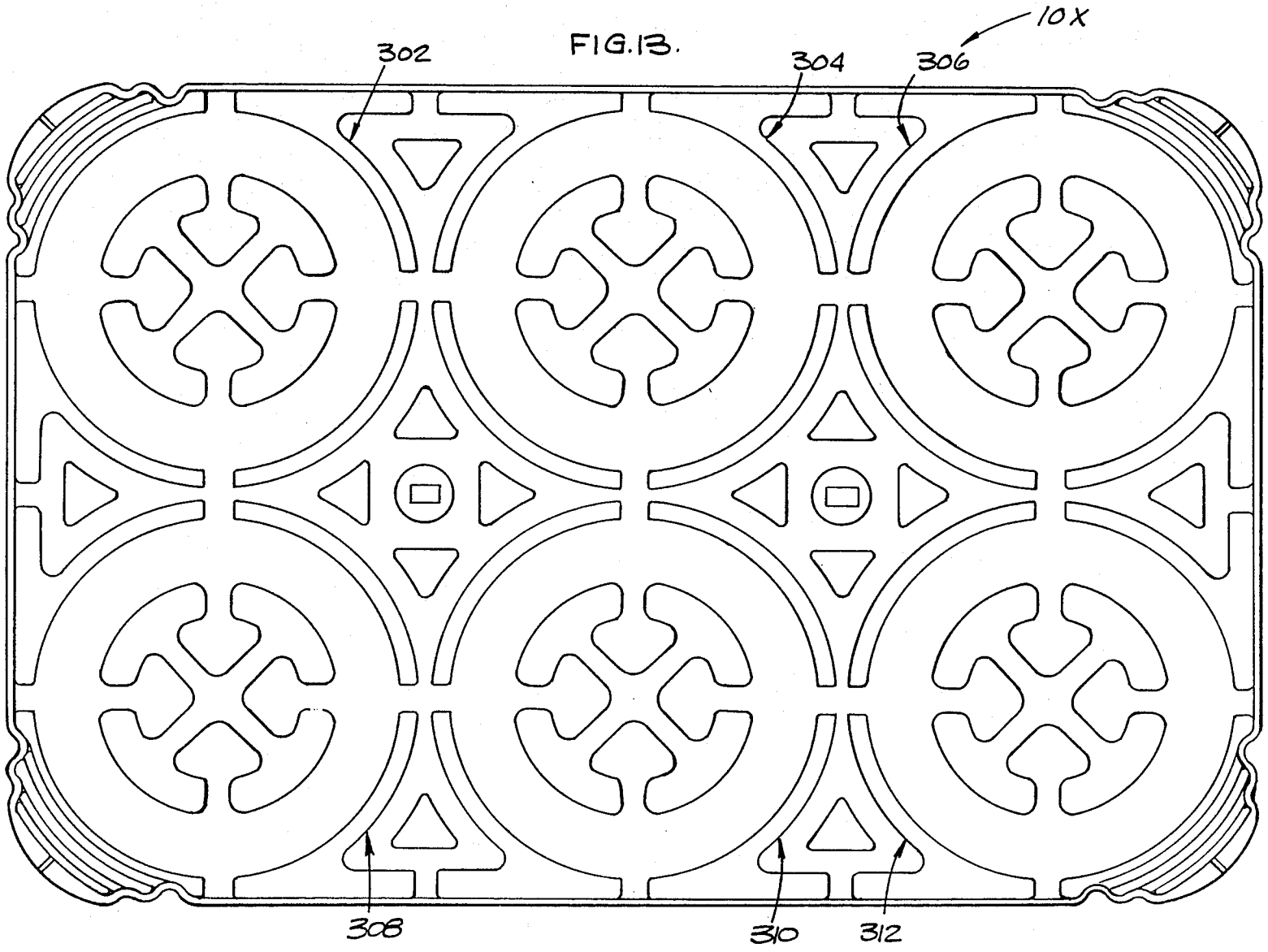
FIG. 13 is a top plan view of a six pocket per side keg board.

FIG. 13 illustrates a keg board 10X identical to the keg board 10 of FIG. 1 except that the middle row of pockets has been eliminated to provide a keg board having six pocket configurations 302, 304, 306, 308, 310, 312, rather than nine, on each side thereof. The external dimensions of the six keg board 10X of FIG. 13 may be 34 inches by 51 inches. The external dimensions of the nine keg board of FIG. 1 may be 51 inches by 51 inches. It has been found that use of either one of or a combination of six keg boards and nine keg boards of such dimensions enables beer kegs to be shipped in a spacially efficient configuration in conventional sized shipping rail cars and trucks as well as delivery trucks.

As illustrated in FIG. 12, keg boards 10 of the present invention are adapted to be positioned between tiers with pocket portions thereof in engagement with the kegs 19 immediately below the board as well as those on top of the board. In FIG. 12, a lower tier of kegs 262 rests on a base surface such as a cargo area floor 260. The lower tier of kegs is engaged at upper portions thereof with a first keg board 10A which in turn supports a middle tier of kegs 264 having lower portions engaged by the pocket portions on the top surface of board 10A. A second keg board 10B similarly engages the upper portion of the middle tier of kegs 264 and the lower portion of an upper tier of kegs 266. The keg boards 10A, 10B may be identical to keg board 10 described above.

The keg boards 10A, 10B maintain the kegs engaged thereby in uniform rows and columns. A forklift fork assembly 270 having prongs 272, 274, 276, 278 is thus readily engageable with each tier of kegs, the outer prongs 272, 278 being slidable along two lower peripheral sides of a tier and the interior prongs 274, 276 being slidable into continuous openings 280, 282 formed between the lower portions of keg rows. In operation, the forklift assembly is initially positioned with prong portions in the alignment relationship shown in FIG. 12. The fork assembly is then pushed horizontally through the keg tier, as indicated at 284, until fork assembly cross member 279 comes into contact with the kegs. The forklift assembly 270 is then raised, as indicated at 286, enabling prong portions 272, 274, 276, 278 to engage the relatively large diameter middle portions 23 of the kegs to thereby lift the entire tier of kegs from the keg board 10B. The kegs are thereafter moved to an unloading station where the above described process is reversed. Keg board 10B may then be removed from the stack and the second tier 264 may be unloaded, etc. In most loading operations, two tiers of full kegs are loaded by the fork lift at once by engagement of the lower of two stacked tiers, e.g. 264, 266. In some operations four tiers of kegs may be lifted and moved at once by a fork lift.

Although an identical process is employed using conventional keg boards, the unloading operation usually also includes removing support banding from kegs on the top tier and/or the manual straightening of keg rows before the keg loading operation is commenced. The present invention eliminates the need for such preliminary operations, thereby substantially increasing the efficiency of keg loading over loading operations performed using conventional plywood keg boards.

It is contemplated that the inventive concepts herein described may be variously otherwise embodied and it is intended that the appended claims be construed to include alternative embodiments of the invention except insofar as limited by the prior art.

What is claimed is:

1. A keg board for use in stacking beer kegs and the like in an upright orientation during storage and transportation of the kegs comprising:

(a) a generally planar surface for engaging and supporting a generally planar end surface of each keg;

(b) pocket means operatively associated with said planar surface for limiting relative lateral shifting movement of said kegs such as caused by shocks and vibration associated with transporting of said kegs;

said keg boards being constructed from two identical plastic sheets, each sheet having planar surfaces on opposite sides thereof, each sheet having a plurality of projecting portions thereon projecting outwardly from one of said planar surfaces and inwardly from the other, said planar surfaces of said two sheets from which said projecting portions project inwardly being adhered together in abutting mirror image relationship whereby the keg board is provided with identical outwardly projecting configurations on opposite exposed surfaces thereof, said outwardly projecting configurations defining said pocket means.

2. A keg board for use with beer kegs and the like of the type having a circular recess in opposite end portions thereof defining ring-shaped, generally planar keg support surfaces, for use in stacking the kegs in an upright orientation during transportation and storage comprising:

a first formed sheet of high density, high molecular weight, weather resistant, ultraviolet radiation resistant, relatively thin, flexible, plastic material;

said sheet having a generally rectangular shape defined by four generally linear peripheral edge portions and four corner portions and having a front side surface and a back side surface;

said formed sheet comprising a flat portion and a plurality of projecting portions, said projecting portions defining a plurality of outwardly extending raised portions on said front side surface and a plurality of corresponding recessed portions on said back side surface;

said projecting portions comprising a plurality of pocket forming projections arranged in a plurality of generally ring-shaped configurations, said ring-shaped pocket configurations each comprising an interior diameter slightly larger than the exterior diameter of an end portion of one of said kegs, said ring-shaped pocket configurations being arranged in a rectangular gridwork of closely spaced rows and columns which are separated by a sufficiently small distance to prevent kegs received in s id pocket configurations from being separated by a distance of more than one inch;

each of said ring-shaped pocket configurations being provided by four arcuate projecting portions each having a projection height of approximately 0.4 inches and a projection width of between approximately 0.4 inches and approximately 1.3 inches and having upper rounded shoulders having a radius of approximately 0.2 inches which are adapted to facilitate seating of a keg in an associated pocket, said four arcuate projecting portions defining each ring-shaped pocket configurations being separated by relatively small circumferential gaps of sufficient dimension to enable drainage of moisture from an area of sad flat portion of said sheet which is circumscribed by said four arcuate projecting portions;

said plurality of projecting portions of said sheet further comprising a plurality of pocket interior stiffening portions positioned within each of said ring-shaped pocket configurations and adapted to stiffen said sheet of material, said pocket interior portions being positioned in centered relationship within said ring-shaped pocket configurations and having projection diameter adapted to be positioned within said recess portion of a keg received within an associated pocket and having a projection height approximately equal to said projection height of said pocket forming projections;

said plurality of projecting portions further comprising plurality of pocket exterior stiffening portions having a projection height approximately equal to the height of said pocket forming projections and positioned within areas of said sheet between said ring-shaped pocket configurations and adapted to further stiffen said sheet;

said plurality of projecting portions further comprising corner shock absorber forming projecting portions comprising three concentric arcuate-portions arranged symmetrically about an axis bisecting an associated corner portion and having an arc which is concave toward the center of said sheet, each of said concentric arcuate portions comprising a projection height approximately equal to the height of said pocket forming projection and having a rounded top portion having a radius of approximately 0.2 inches, said concentric arcuate portions being positioned approximately 0.3 inches apart;

said projecting portions of said sheet being constructed and arranged to provide gaps within all flat areas enclosed by said projections for enabling drainage of moisture from all areas of said sheet;

said corner portions of said sheet comprising a plurality of inwardly projecting curved edge portions adapted to facilitate stacking of the sheets.

3. The invention of claim 2 further comprising:

a second sheet substantially identical to said first sheet, said first sheet and said second sheet being adhered together at said flat portion of said back side surfaces thereof whereby a unitary keg board having identical top and bottom surfaces defined by said front side surfaces of said two sheets is provided.

4. The invention of claim 3 further comprising a linear vent passage provided at each corner of the keg board and defined by a recess portion in the back side surface of each sheet, said vent passage being in fluid communication with the recesses associated with each of the shock absorber forming projections located at an associated corner, said vent passage being in fluid communication with the atmosphere whereby air discharge and intake from said shock. absorber forming projections during compression and expansion of said shock absorber forming projections is provided.

5. The invention of claim 2 or 3, said first formed sheet comprising a sheet of black polyethylene material having a pre-formed thickness of not less than approximately 0.08 inches.

6. The invention of claim 2, said first formed sheet having six of said ring-shaped pocket configurations and having external dimensions of fifty-one inches by thirty-four inches.

7. The invention of claim 2, said first formed sheet having nine of said ring-shaped pocket configurations and having external dimensions of fifty-one inches by fifty-one inches.

8. A keg board and keg assembly comprising:

(a) a plurality of kegs of the type having circular end portions defining generally planar keg support surfaces for use in stacking the kegs in an upright orientation during transportation and storage;

(b) a first formed sheet of high density, high molecular weight, weather resistant, ultraviolet radiation resistant, relatively thin, flexible, plastic material;

said sheet having a generally rectangular shape defined by four generally linear peripheral edge portions and four corner portions and having a front side surface and a back side surface;

said formed sheet comprising a flat portion and a plurality of projecting portions, said projecting portions defining a plurality of outwardly extending raised portions on said front side surface and a plurality of corresponding recessed portions on said back side surface;

said projecting portions comprising a plurality of pocket forming projections arranged in a plurality of generally ring-shaped configurations, said ring-shaped pocket configurations each comprising an interior diameter slightly larger than the exterior diameter of an end portion of one of said kegs, said ring-shaped pocket configurations being arranged in a rectangular gridwork of closely spaced rows and columns which are separated by a sufficiently small distance to prevent kegs received in said pocket configurations from being separated by a distance of more than one inch at the maximum diameter of the kegs;

said plurality of projecting portions of said sheet further comprising a plurality of stiffening portions having a projection height approximately equal to said projection height of said pocket forming projections and adapted to stiffen said sheet of material.

9. The invention of claim 8:

said plurality of projecting portions further comprising corner shock absorber forming projecting portions comprising a plurality of concentric arcuate portions arranged symmetrically about an axis bisecting an associated corner portion, each said concentric arcuate portions comprising a projection height approximately equal to the height of said pocket forming projection.

10. The invention of claim 8:

said projecting portions of said sheet being constructed and arranged to provide gaps leading from flat areas enclosed by said projections for enabling drainage of moisture rom all flat areas of said sheet.

11. The invention of claim 8:

said corner portions of said sheet comprising a plurality of inwardly projecting curved edge portions adapted to facilitate stacking of the sheets.

12. The invention of any of claims 8–11 further comprising:

a second sheet substantially identical to said first sheet said first sheet and said second sheet being adhered together at said back side surfaces thereof whereby a unitary keg board having identical top and bottom surfaces defined by said front side surfaces of said two sheets is provided.

13. A method of stacking beer kegs for shipping comprising the steps of:

(a) providing a keg board of the type comprising:

a generally planar surface for engaging and supporting a generally planar end surface of each keg;

pocket means operatively associated with said planar surface for limiting relative lateral shifting movement of said kegs such as caused by shocks and vibration associated with transporting of said kegs;

said keg board being constructed from two identical plastic sheets, each sheet having planar surfaces on opposite sides thereof, each sheet having a plurality of projecting portions thereon projecting outwardly from one of said planar surfaces and inwardly from the other, said planar surfaces of said two sheets from which said projecting portions project inwardly being adhered together in abutting mirror image relationship whereby the keg board is provided with identical outwardly projecting configurations on opposite exposed surfaces thereof, said outwardly projecting configurations defining said pocket means;

(b) placing a plurality of beer kegs in close, upright, adjacent relationship in a rectangular configuration of rows and columns;

(c) placing the keg board on top of the plurality of beer kegs with pocket portions on the bottom surface of the keg board engaging the top ends of all of the kegs;

(d) stacking plurality of upper tier kegs on top of the keg board with bottom ends of the upper tier of kegs in engaging relationship with the pockets in the top surface of the keg board.

14. A keg board for use in a stacking beer kegs and the like in an upright orientation during storage and transportation of the kegs comprising:

(a) a generally planar surface for engaging and supporting a generally planar end surface of each keg;

(b) pocket means operatively associated with said planar surface for limiting relative lateral shifting movement of said kegs such as caused by shocks and vibration associated with transporting of said kegs;

(c) peripheral shock absorbing means for absorbing shocks associated with dropping of the keg board on a peripheral edge portion thereof such as is often encountered during collection and stacking of keg boards subsequent to unloading of kegs therefrom, said peripheral shock absorbing means comprising a plurality of concentric arcuate projections located at at least one peripheral portion of said keg board; each of said concentric arcuate projections providing a resiliently collapsible bellows chamber; each of said bellows chambers formed by said concentric arcuate projection comprising a vent passageway for venting air within said bellows chamber to the atmosphere for enabling shock absorbing collapse of the associated bellows chamber in response to a compressive shock.

* * * * *